United States Patent [19]

Heffernan et al.

[11] Patent Number: 4,702,225

[45] Date of Patent: Oct. 27, 1987

[54] CONTROL FOR HEAT PIPE CENTRAL FURNACE

[75] Inventors: Edward J. Heffernan, Oviedo, Fla.; Ronald S. Tomlinson, Mt. Juliet, Tenn.

[73] Assignee: Heil-Quaker Corporation, Lavergne, Tenn.

[21] Appl. No.: 863,147

[22] Filed: May 14, 1986

[51] Int. Cl.[4] ..... F24H 3/00

[52] U.S. Cl. ..... 126/116 A; 126/116 R; 126/110 R; 165/104.11; 165/104.26

[58] Field of Search ..... 126/110, 99 R, 110 R, 126/116 A, 116 R; 165/13, 29, 104.11, 104.26

[56] References Cited

U.S. PATENT DOCUMENTS

| | | | |
|---|---|---|---|
| 3,996,919 | 12/1976 | Hepp | 126/433 |
| 4,275,705 | 6/1981 | Schaus et al. | 126/116 R X |
| 4,412,421 | 11/1983 | Smith, Jr. | 122/4 D X |
| 4,577,615 | 3/1976 | Tomlinson | 126/116 R X |

*Primary Examiner*—Larry Jones

*Attorney, Agent, or Firm*—Jeffers, Hoffman & Niewyk

[57] ABSTRACT

In the operation of a heat pipe furnace having a plurality of heat pipes and means for conducting a heated fluid in sequential heat transfer association with the heat pipes, an apparatus and method of detecting a malfunction of any one of the heat pipes of said plurality comprising means for and the steps of monitoring the temperature of the most sequentially downstream heat pipe of the plurality of heat pipes and determining whether said monitored temperature is within a preselected range of temperatures.

9 Claims, 6 Drawing Figures

FIG. 5
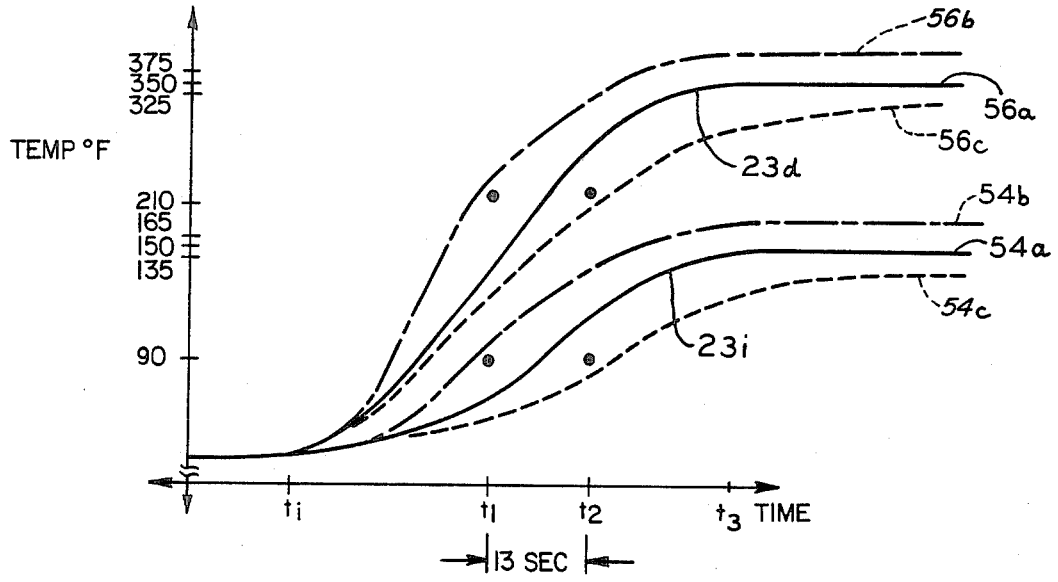
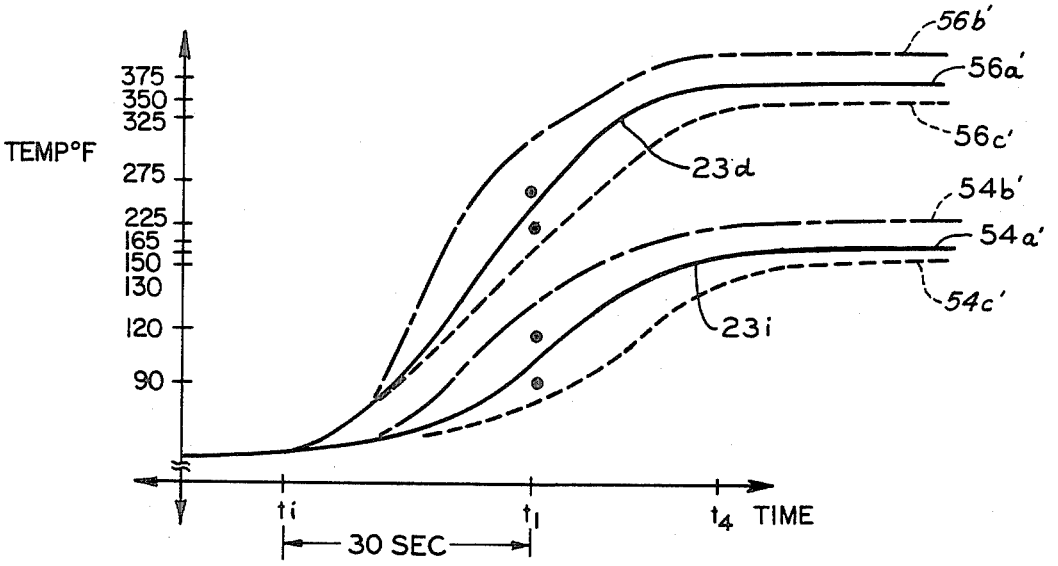
FIG. 6

CONTROL FOR HEAT PIPE CENTRAL FURNACE

BACKGROUND OF THE INVENTION

1. Field of the Invention

The invention relates to furnaces comprising a plurality of heat pipes and more particularly to a control to detect a malfunction of any of the heat pipes.

2. Description of the Background Art

Heat pipe furnaces typically comprise a plurality of heat pipes for transferring heat energy from a heat source, for example air heated by a burner, to a medium to be heated, for example conditioned air circulated throughout a building.

A heat pipe comprises a sealed tubed containing a vaporizable fluid formed of a horizontal evaporator section and an upwardly inclined condenser section sealingly connected thereto.

The evaporator sections of the heat pipes are sequentially located in the proximity of the heated air, and the heated air passes thereover.

Heat energy in the heated air is removed by the evaporator sections, causing the vaporizable fluid in the evaporator sections to vaporize. The vapor then travels upwardly into the condenser section.

The condenser sections of the heat pipes are located in the proximity of the conditioned air, and the conditioned air passes over the condenser sections. The vapor therein is condensed to fluid upon the release of the heat energy therefrom to the conditioned air. Once condensed, gravity causes the fluid to return to the evaporator sections where the fluid will again be vaporized in a cyclical manner.

Individual heat pipes are subject to malfunctions. For example, a leak can cause the heat pipe to lose fluid. Moreover, a vapor lock can occur wherein a vapor bubble forms in the heat pipe preventing the cyclic flow of the fluid. Such a malfunction will cause the evaporator section not to remove sufficient heat energy from the heated air and, hence, will cause the associated condensing portion to function at an abnormally low temperature. As a result, furnace efficiency decreases and further damage to the malfunctioning heat pipe can occur.

One method of detecting the malfunction of one of the heat pipes has been to individually monitor the operating temperature of each of the heat pipes. However, such individual monitoring adds to the overall cost of the furnace and adds to the furnace additional items having a potential to fail.

SUMMARY OF THE INVENTION

The temperature of the heated air at a given point depends both upon the heat generated by the burner, which is constant, and the heat energy removed from the heated air by the evaporator portions of the heat pipes located upstream therefrom.

The amount of heat energy removed by the upstream evaporator sections depends upon the number of upstream heat pipes functioning properly.

Thus by monitoring the temperature of one of the heat pipes, one can determine whether the monitored heat pipe, or any of the heat pipes located upstream therefrom, is properly functioning.

In accordance with the present invention, nine heat pipes are sequentially arranged in a heat pipe furnace. Temperature sensors are located on the fourth and ninth heat pipes and the temperatures thereof are continuously monitored.

During start-up of the furnace upon ignition of the burner, if any of the heat pipes located upstream of one of the monitored heat pipes malfunctions, the heat energy applied to the monitored heat pipe will be greater than normal and, therefore, the temperature of the monitored heat pipe will increase at a rate faster than normal.

Further, if the monitored heat pipe malfunctions, the temperature of the monitored heat pipe will increase at a rate slower than normal.

Additionally, if any of the heat pipes located upstream of one of the monitored heat pipes should malfunction during steady state operation of the furnace, the monitored heat pipe will operate at a higher-than-normal steady state temperature.

Moreover, if one of the monitored heat pipes malfunctions during steady state operation of the furnace, the monitored heat pipe will operate at a lower-than-normal steady state temperature.

In a first embodiment, the temperature of the fourth and ninth heat pipes are determined at a first time and at a second subsequent time following ignition of the burner. A threshold temperature for each monitored heat pipe is predetermined, based upon various parameters of the specific furnace. An operating temperature range is also predetermined, the specific valve of which is based upon various parameters of the furnace.

Proper start-up operation of all of the heat pipes is indicated if the temperatures of the monitored heat pipes are below their respective threshold temperatures at the first time and are above their respective threshold temperatures at the second time.

Proper steady state operation of all of the heat pipes is indicated if the temperatures of the monitored heat pipes remain within the operating temperature range upon attaining steady state operation.

In a second embodiment, the temperatures of the fourth and ninth heat pipes are determined at a point in time prior to steady state operation. Two pairs of upper and lower threshold temperatures, one pair for each of the monitored heat pipes, are predetermined, again based upon various parameters of the specific furnace.

As with the first embodiment, an operating temperature range is also predetermined.

Proper start-up operation of all of the heat pipes is indicated if the temperatures of the monitored heat pipes at the point in time are within the pair of respective upper and lower threshold temperatures.

Moreover, proper steady state operation of all of the heat pipes is indicated if the sensed temperatures of the monitored heat pipes remain within the operating temperature range upon attaining steady state operation.

BRIEF DESCRIPTION OF THE DRAWING

Other features and advantages of the invention will be apparent from the following description taken in connection with the accompanying drawing wherein:

FIG. 5 is a temperature vs. time curve illustrating the first embodiment; and FIG. 6 is a temperature vs. time curve illustrating the second embodiment.

DESCRIPTION OF THE PREFERRED EMBODIMENT

Figure 1:
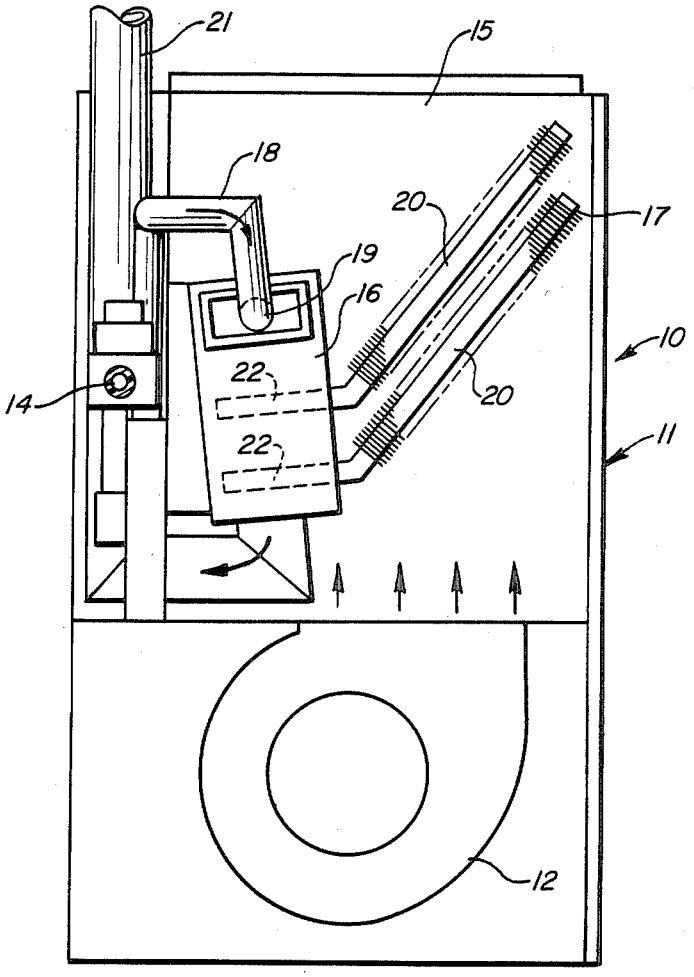
FIG. 1 is a side elevation of a heat pipe furnace.

In the illustrative embodiment of the invention as disclosed in FIG. 1, a central forced air furnace generally designated 10 for heating a building comprises an enclosure 11 housing a conditioned air blower 12. A combustible fuel, such as a hydrocarbon gas, is provided to the furnace 10 by a gas line (not shown) through a conventional gas valve 14.

The furnace includes a heat exchange chamber generally designated 15 having a heat input portion or combustion chamber enclosure 16 and a heat output portion 17. The furnace further includes a control (not shown) discussed in greater detail below.

The gas is mixed with air and the gas-air mixture is delivered by means of a combustion blower (not shown) through a transfer pipe 18 to an inlet portion 19 of the combustion chamber enclosure 16. The gas-air mixture is ignited, producing heated air as a combustion product.

The heated air is passed in heat exchange relationship with nine heat pipes 20 and then discharged from the furnace 10 through a conventional vent pipe 21.

As discussed in greater detail below, the heat pipes 20 transfer heat energy from the combustion chamber 16 to the heat output portion 17. The conditioned air blower 12 then circulates the transferred heat energy in the form of conditioned air throughout the building.

Figure 2:
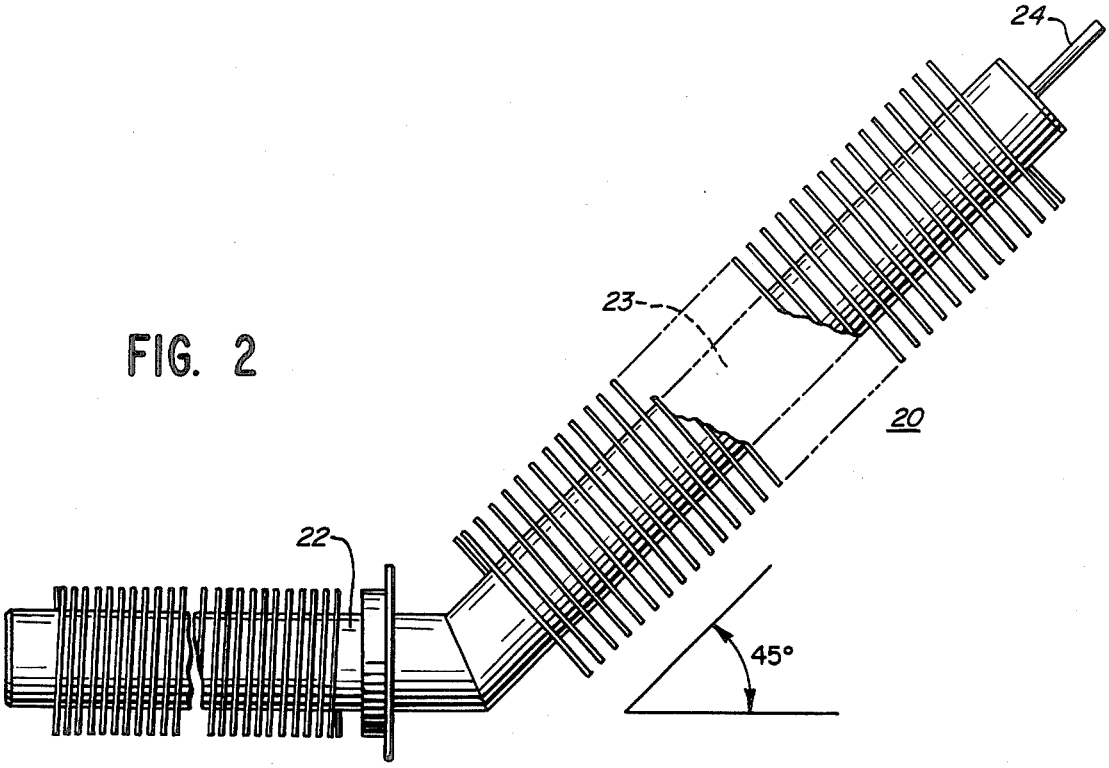
FIG. 2 is an elevation of a heat pipe.

Referring to FIG. 2, the heat pipe 20 comprises a sealingly closed tube having a horizontal evaporator portion 22 and a condenser portion 23 extending upwardly at an angle such as 45°. The heat pipe 20 is filled through a sealable filling pipe 24 with a suitable condensable heat transfer fluid which, in the illustrated embodiment, comprises distilled and deaerated water with 5% sodium chromate dissolved therein. The heat pipe 20 is formed of stainless steel such as 304 or 316 stainless steel.

A further description of the heat pipe 20 can be found in my co-pending application entitled Heat Pipe Central Furnace, U.S. Pat. No. 4,577,615, issued Mar. 25, 1986 which is assigned to the same assignee as the present application.

Figure 3:
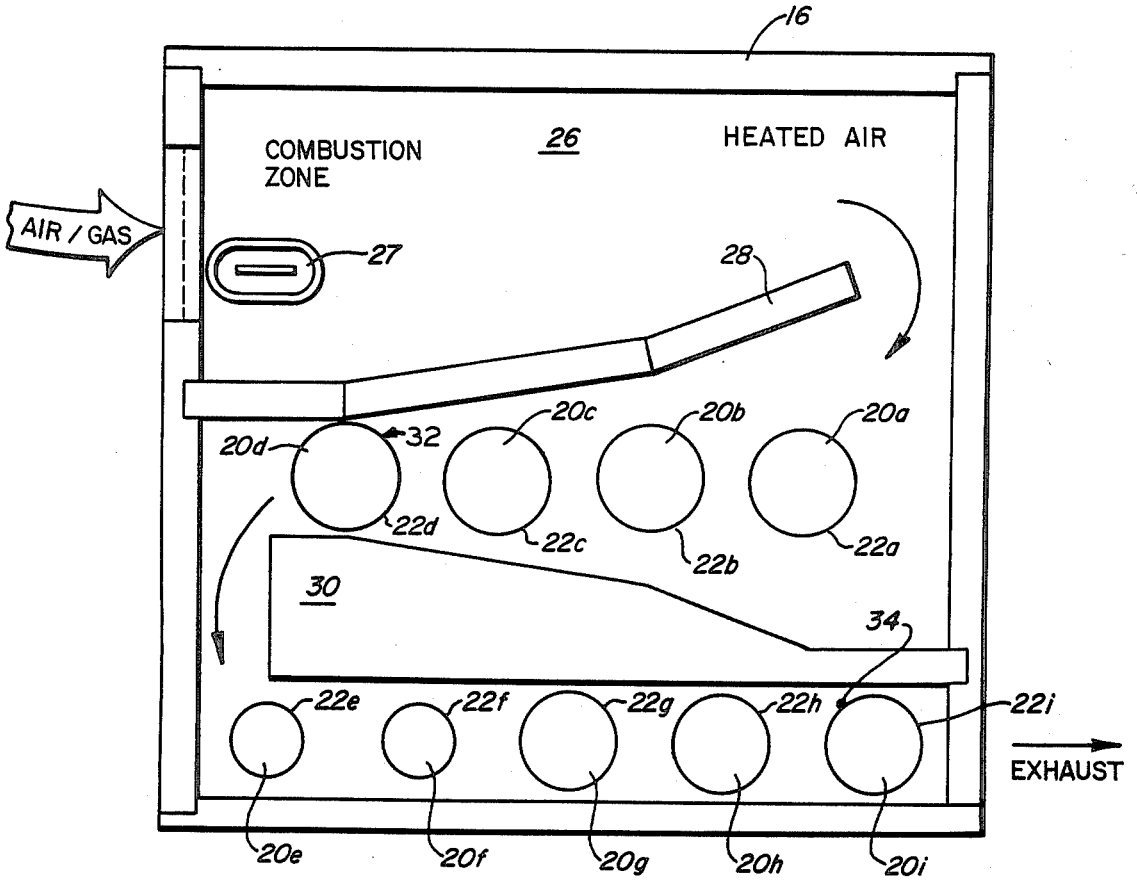
FIG. 3 is a vertical section of a heat transfer chamber taken along line 2—2 of FIG. 1.

Referring now to FIG. 3, a vertical section of the combustion chamber enclosure 16 taken along line 2—2 of FIG. 1 is illustrated.

The gas-air mixture enters the combustion chamber enclosure 16 where it is ignited in a combustion zone 26 by an ignitor 27. The combustion of the gas-air mixture produces the heated air which flows first around a first baffle 28 then flowing sequentially over first through fourth evaporator portions 22*a*–22*d* of first through fourth heat pipes 20*a*–20*d*. The heated air continues to flow around a second baffle 30, then flowing sequentially over fifth through ninth evaporator portions 22*e*–22*i* of fifth through ninth heat pipes 20*e*–20*i*. The heated air is then exhausted through the vent pipe 21 (FIG. 1).

As the heated air flows around the first baffle 28, the heated gas vaporizes the heat transfer fluid within the first evaporator portion 22*a*, causing the vaporized heat transfer fluid to move upwardly into the first condenser portion 23*a*. Conditioned air passing over the first condenser portion 23*a* causes the vaporized heat transfer fluid to condense and flow by gravity back into the first evaporator portion 22*a*. Such cyclical vaporization and condensation continuously removes heat energy from the heated gas, thereby transferring the heat energy to the conditioned air.

The heated air, after flowing around the first heat pipe 20*a* is cooled by an amount equal to the heat energy removed thereby.

Similarly, the heated gas passing over the remaining eight heat pipes 20*b*–20*i* causes the heat transfer fluid therein to also cyclically vaporize and condense. Thus, the evaporator portion 22 of the heat pipe 20 affects the temperature of the heated air passing thereover.

A malfunction of the first heat pipe 20*a* will therefore cause hotter-than-normal heated air to pass over the second through ninth heat pipes 20*b*–20*i* located downstream therefrom.

Such a malfunction occurring during start-up of the furnace will cause the second through ninth heat pipes 20*b*–20*i* to heat at a rate faster than normal.

Further, such a malfunction occurring during steady state operation thereof will cause the second through ninth heat pipes 20*b*–20*i* to operate at a temperature which is hotter than normal. Therefore by monitoring the temperature of one of the heat pipes 20, one can determine whether a malfunction of any of the heat pipes located upstream therefrom has occurred.

Further, a failure of one of the sensed heat pipes 20 will cause that particular heat pipe 20 to heat up slower upon start-up and to a lower temperature upon steady state operation. Therefore, a malfunction of the sensed heat pipe 20 can also be determined.

A first temperature sensor 32 is located on the condenser portion 23*c* of the fourth heat pipe 20*d* and is capable of sensing the temperature thereof. A second temperature sensor 34 is located upon the ninth condenser portion 23*i* of the ninth heat pipe 20*i* and is capable of sensing the temperature thereof. The temperature sensors 32, 34 could be physically located anywhere along the fourth and ninth condenser portions 23*d*, 23*i* as the temperature variations are small (±10° F.).

As a failure of one of the heat pipes 20 will affect the temperature of the heated air passing over all of the heat pipes 20 located downstream therefrom, only sensing the ninth heat pipe 20*i* is required. However, in the preferred embodiments herein disclosed, the temperature of the fourth heat pipe 20*d* is also sensed for added sensitivity.

Figure 4:
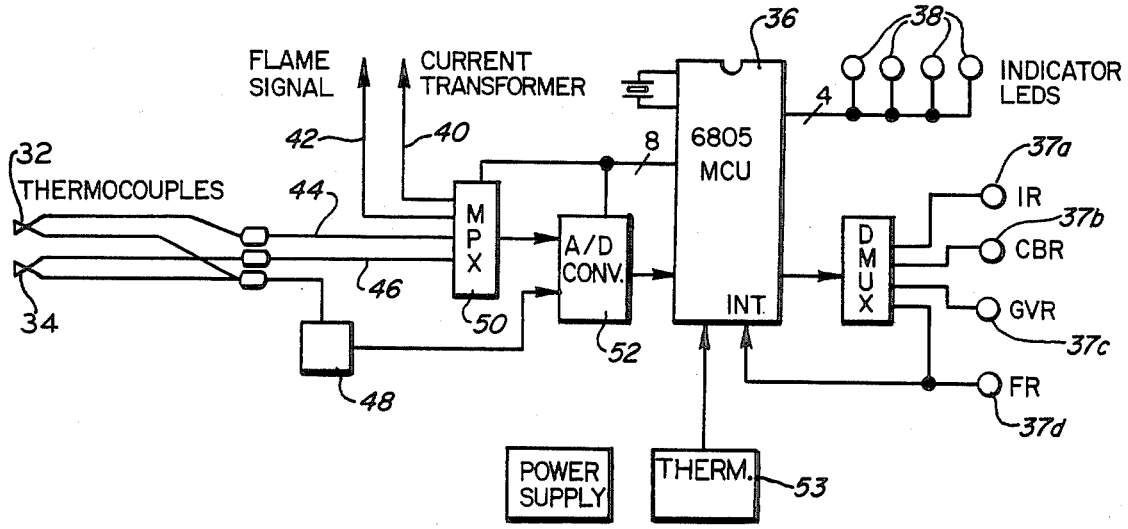
FIG. 4 is a block diagram illustrating the present control.

Referring to FIG. 4, the control for the heat pipe furnace comprises a single board system with all the functions except sensors integrated onto a single printed circuit (PC) board.

Central to the operation of the control is a single chip microcomputer 36, for example an MC 68705P3-5 manufactured by Motorola, Inc. The microcomputer 36 provides all logic and timing operations for the control.

The microcomputer 36 controls four relays consisting of a relay 37*a* for the ignitor 27, a relay 37*b* for the combustion blower, a relay 37*c* for the gas valve 14, and a relay 37*d* for the conditioned air blower 12.

Contacts of the combustion blower relay and the gas valve relay are coupled in series to control operation of the gas valve 14.

The microcomputer 36 further controls four light emitting diodes 38, or LEDs, for diagnostic purposes. The LEDs 38 indicate the state of operation of the control.

The control further includes first through fourth analog inputs 40, 42, 44, 46.

The first analog input 40 is coupled to a current transformer which measures current drawn by the combustion blower motor (not shown), the ignitor 27 and the conditioned air blower 12.

The second analog input 42 is coupled to a sensor for generating a flame signal utilizing flame rectification.

The third analog input 44 is coupled to the first temperature sensor 32 and the fourth analog input is coupled to the second temperature sensor 34.

A temperature tranducer 48 is in thermal contact with each thermocouple junction on the PC board to provide temperature compensation. The signal from the first and second temperature sensors 32, 34 are therefore a function of absolute temperature.

A multiplexer 50 multiplexes signals received at the four analog inputs 40, 42, 44, 46, and an analog to digital (A/D) converter 52 converts the analog multiplexed signal generated by the multiplexer 50 to a digital multiplexed signal. The digital multiplexed signal is received by the microcomputer 36, where the signal is demultiplexed and the information contained therein is utilized by the control.

The control also receives a digital signal from a thermostat 53 which indicates when the furnace should be turned on.

Upon a command from the thermostat for the furnace to turn on, typical furnace start-up procedures are initiated by the control. The start-up procedures are common to furnace controls generally, and further discussion thereof is not required.

Upon completion of the start-up procedures, including ignition of the gas-air mixture, the control verifies both whether the temperature rise rates of the fourth and ninth condenser sections **23*d*, 23*i* are within an acceptable range and also whether the steady state temperatures of these fourth and ninth condenser sections 23*d*, 23*i*** remain within acceptable limits.

Two alternative embodiments are contemplated to accomplish the required verification.

Referring now to FIG. 5, a graph illustrates a first embodiment of the control. Lines 54, 56 illustrate temperature vs. time characteristics of the fourth and ninth condenser sections **23*d*, 23*i***, respectively.

At a time $t_i$, the gas-air mixture is ignited and the temperature of the condenser sections 23 begins to rise.

Threshold temperatures, the specific values of which depend upon the particular furnace configuration, are 90° F. for the ninth condenser section **23*i*, and 210° F. for the fourth condenser section 23*d*** in the first embodiment.

A time window is defined by a first time $t_1$ occurring 25 seconds following ignition of the gas-air mixture ($t_i$), and a second time $t_2$ occurring 13 seconds following $t_1$.

Successful start-up of the furnace is indicated when the temperature of the fourth and ninth condenser sections **23*d*, 23*i* cross their respective threshold temperatures during the time window, as illustrated by solid lines 54*a*, 56*a***.

Crossing the threshold temperature too soon, as indicated by broken lines **54*b*, 56*b*, indicates that the heated air is hotter than normal, and hence, one of the heat pipes 20** located upstream therefrom is malfunctioning.

Crossing the threshold temperature too late, as indicated by dashed lines **54*c*, 56*c* indicates a malfunction of the particular heat pipe being sensed, 20*d* or 20*i***.

In the event successful start-up of the furnace is not indicated, the control initiates a typical shut-down procedure including termination of the ignition of the gas-air mixture.

Further, upon reaching a steady state temperature at $t_3$ (approximately 45 seconds following ti), the control continuously monitors the steady state temperatures of the fourth and ninth condenser sections **23*d*, 23*i* to insure they remain within an acceptable range. The steady state temperature of the fourth condenser section 23*d*** must remain 350° F.±25° F. and the steady state temperature of the ninth condenser section must remain 150° F.±15° F.

If the steady state temperature of either the fourth or ninth condenser section **23*d*, 23*i*** should deviate from the acceptable range, shut-down procedures are also initiated by the control.

Referring now to FIG. 6, a graph illustrates a second embodiment of the control. Lines 54′, 56′ illustrating the temperature vs. time characteristics of the fourth and ninth condenser sections **23*d*, 23*i* are identical to the lines 54, 56 of FIG. 5**.

Upper and lower threshold temperatures, the specific values of which depend upon the configuration of the particular furnace, are 275° F. and 225° F. for the fourth condenser section **23*d* and 120° F. and 90° F. for the ninth condenser section 23*i***, respectively.

At the time $t_i$, the gas-air mixture is ignited. Successful start-up of the furnace is indicated if the temperature of the fourth and ninth condenser sections **23*d*, 23*i*** are between their respective upper and lower threshold temperatures at a time $t_1$ occurring 30 seconds subsequent to the time $t_i$. Otherwise, a malfunction is indicated and the furnace is shut-down.

The broken lines **54*b*′, 56*b*′ illustrate the temperature vs. time curves of the fourth and ninth condensor sections 23*d*, 23*i* when one of the upwind heat pipes 20** is malfunctioning.

The dashed lines **54*c*′, 56*c*′ illustrate the temperature vs. time curves of the fourth and ninth condensor sections 23*d*, 23*i* when that particular heat pipe, 23*d* or 23*i*** is malfunctioning.

As explained in conjunction with FIG. 5 and the first embodiment, the steady state temperature of the fourth and ninth condenser sections **23*d*, 23*i* are also monitored after a time $t_4$ (approximately 45 seconds following $t_i$) to insure the temperature of the fourth condenser section 23*d* remains 350° F.±25° F. and the temperature of the ninth condenser section 23*i*** remains 150° F.±15° F.

It is to be understood that other methods and apparatus not specifically disclosed herein may be utilized to accomplish the present invention without departing from the scope of the invention.

We claim:

1. In the operation of a heat pipe furnace having a plurality of heat pipes and means for conducting a heated fluid in sequential heat transfer association with the heat pipes, a method of detecting a malfunction of any one of the heat pipes of said plurality comprising:

monitoring the temperature of one of said heat pipes;

preselecting a time window defined by a first point in time and a second, subsequent, point in time following initiation of heat transfer to said plurality of heat pipes and prior to steady state operation of the furnace;

preselecting a threshold temperature; and determining whether said monitored temperature is less than the threshold temperature at said first point in time and whether said monitored temperature is greater than the threshold temperature at said second point in time.

2. In the operation of a heat pipe furnace having a plurality of heat pipes and means for conducting a heated fluid in sequential heat transfer association with the heat pipes, a method of detecting a malfunction of any one of the heat pipes of said plurality comprising:

preselecting a point in time following initiation of heat transfer to said plurality of heat pipes and prior to steady state operation of the furnace;

preselecting a range of temperatures between a first threshold temperature and a second threshold temperature; and determining whether said monitored temperature at said point in time is within said preselected range of temperatures.

3. In the operation of a heat pipe furnace having a plurality of heat pipes and means for conducting a heated fluid in sequential heat transfer association with the heat pipes, a method of detecting a malfunction of any one of the heat pipes of said plurality comprising:

determining whether the furnace has obtained steady state operation;

preselecting a temperature window defining a range of temperature between a first threshold temperature and a second threshold temperature; and determining whether said monitored temperature remains within said preselected temperature range during said steady state operation.

4. In a heat pipe furnace having a plurality of heat pipes and means for conducting a heated fluid in sequential heat transfer association with the heat pipes, an apparatus for detecting a malfunction of any one of said heat pipes comprising:

means for monitoring the temperature of at least one heat pipe of said plurality of heat pipes;

means for preselecting a time window defining a first point in time and a second, subsequent, point in time following initiation of heat transfer to said plurality of heat pipes and prior to steady state operation of the furnace;

means for preselecting a threshold temperature; and means for determining whether said monitored temperature is less than said threshold temperature at said first point in time and whether said monitored temperature is greater than said threshold temperature at said second point in time.

5. In a heat pipe furnace having a plurality of heat pipes and means for conducting a heated fluid in sequential heat transfer association with the heat pipes, an apparatus for detecting a malfunction of any one of said heat pipes comprising:

means for preselecting a point in time following initiation of heat transfer to said plurality of heat pipes and prior to steady state operation of the furnace;

means for preselecting a range of temperatures between a first threshold temperature and a second threshold temperature; and means for determining whether said monitored temperature at said point in time is within said range of temperatures.

6. In a heat pipe furnace having a plurality of heat pipes and means for conducting a heated fluid in sequential heat transfer association with the heat pipes, an apparatus for detecting a malfunction of any one of said heat pipes comprising:

means for determining when said furnace has attained steady state operation;

means for preselecting a range of temperatures between a first threshold temperature and a second threshold temperature; and means for determining whether said monitored temperature remains within said preselected temperature range.

7. In a heat pipe furnace having a heat source and a plurality of serially heated heat pipes, a method of detecting a malfunction of any one of the heat pipes comprising the steps of:

determining a time interval extending from a first preselected time to a second preselected time;

continuously monitoring the temperature of one of said heat pipes of said plurality of heat pipes;

preselecting a first threshold temperature; and determining whether said monitored temperature of said one heat pipe exceeds said first threshold temperature during said time interval;

continuously monitoring the temperature of a second of said heat pipes;

preselecting a second threshold temperature; and determining whether said monitored temperature of said second heat pipe exceeds said second threshold temperature during said time interval.

8. In a heat pipe furnace having a heat source, a plurality of heat pipes in sequential heat transfer association with the heat source and means associated with the most sequentially downstream heat pipe of said plurality of heat pipes for determining the temperature thereof, a method of detecting a malfunction of any one of the heat pipes comprising the steps of:

preselecting a temperature range;

monitoring the temperature of a selected heat pipe at a preselected point in time following initiation of heat transfer to said plurality of heat pipes; and determining whether said monitored temperature is within said temperature range.

9. The method of detecting the malfunction of any one of said heat pipes as claimed in claim 8 wherein said temperature of said selected heat pipe is monitored upon attaining steady state operation of the furnace.

* * * * *